US006988345B1

(12) United States Patent
Pelfrey et al.

(10) Patent No.: US 6,988,345 B1
(45) Date of Patent: Jan. 24, 2006

(54) LINEAL

(75) Inventors: Paul R. Pelfrey, Wheelersburg, OH (US); Larry R. Fairbanks, Columbus, OH (US); Jan E. Byer, Canal Winchester, OH (US)

(73) Assignee: Crane Plastics Company LLC, Columbus, OH (US)

( * ) Notice: Subject to any disclaimer, the term of this patent is extended or adjusted under 35 U.S.C. 154(b) by 0 days.

(21) Appl. No.: 11/101,123

(22) Filed: Apr. 7, 2005

Related U.S. Application Data

(63) Continuation of application No. 10/357,120, filed on Feb. 3, 2003.

(51) Int. Cl.
*E04D 1/34* (2006.01)

(52) U.S. Cl. ..... 52/519; 52/520; 52/521; 52/522; 52/545; 52/551; 52/556

(58) Field of Classification Search ..... 52/519, 52/520, 526, 545, 548, 551, 553, 556, 521, 52/522
See application file for complete search history.

(56) References Cited

U.S. PATENT DOCUMENTS

| | | | | |
|---|---|---|---|---|
| 1,589,675 | A | 6/1926 | Belding | 52/522 |
| 1,728,934 | A | 9/1929 | Hogenson | 206/322 |
| 2,830,546 | A | 4/1958 | Rippe | 108/17 |
| D196,230 | S | 9/1963 | Raftery et al. | D13/1 |
| 3,159,943 | A | 12/1964 | Sugar et al. | 50/200 |
| 3,233,382 | A | 2/1966 | Graveley, Jr. | 52/522 |
| 3,246,436 | A | 4/1966 | Roush | 52/303 |
| 3,289,365 | A | 12/1966 | McLaughlin et al. | 52/173 |
| 3,289,380 | A | 12/1966 | Charniga, Jr. | 52/716 |
| 3,325,952 | A | 6/1967 | Trachtenberg | 52/276 |
| D208,251 | S | 8/1967 | Facer | D13/1 |
| 3,387,418 | A | 6/1968 | Tyrer | 52/242 |
| 3,399,916 | A | 9/1968 | Ensor | 287/189.36 |
| 3,473,274 | A | 10/1969 | Godes | 52/127 |
| 3,520,099 | A | 7/1970 | Mattes | 52/531 |
| 3,552,078 | A | 1/1971 | Mattes | 52/520 |
| 3,555,762 | A | 1/1971 | Costanzo, Jr. | 52/588 |
| 3,637,459 | A | 1/1972 | Parish et al. | 161/161 |
| 3,703,795 | A | 11/1972 | Mattes | 52/521 |
| 3,815,310 | A | 6/1974 | Kessler | 52/531 |
| 3,826,054 | A | 7/1974 | Culpepper, Jr. | 52/309 |
| 3,969,866 | A | 7/1976 | Kyne | 52/588 |
| 3,970,502 | A | 7/1976 | Turner | 156/310 |
| 4,001,997 | A | 1/1977 | Saltzman | 52/521 |
| 4,033,802 | A | 7/1977 | Culpepper, Jr. et al. | 156/71 |

(Continued)

FOREIGN PATENT DOCUMENTS

| | | |
|---|---|---|
| CA | 96829 | 8/2002 |

(Continued)

OTHER PUBLICATIONS

Sweet's General Building & Renovation, 1995 Catalog File; section 07460 on Siding, pp. 4-20.

(Continued)

*Primary Examiner*—Rodney B. White
(74) *Attorney, Agent, or Firm*—Standley Law Group LLP

(57) ABSTRACT

A lineal for framing openings in buildings that may provide a finished appearance to the opening being framed. The lineal may be comprised of a nailing hem and an overhang. The lineal may additionally comprise a channel portion. The lineal with a channel portion may be manufactured as a one-piece or two-piece unit. The two-piece unit may have a portion that slides onto or snaps into the channel portion. The lineal may have insulation applied to its underside.

20 Claims, 8 Drawing Sheets

U.S. PATENT DOCUMENTS

| | | | | |
|---|---|---|---|---|
| 4,034,528 | A | 7/1977 | Sanders et al. | 52/309.4 |
| 4,081,939 | A | 4/1978 | Culpepper, Jr. et al. | 52/535 |
| 4,096,011 | A | 6/1978 | Sanders et al. | 156/196 |
| 4,102,106 | A | 7/1978 | Golder et al. | 52/533 |
| 4,104,841 | A | 8/1978 | Naz | 52/519 |
| 4,118,166 | A | 10/1978 | Bartrum | 425/462 |
| 4,188,762 | A | 2/1980 | Tellman | 52/541 |
| 4,189,885 | A | 2/1980 | Fritz | 52/287 |
| 4,272,576 | A | 6/1981 | Britson | 428/100 |
| 4,279,106 | A | 7/1981 | Gleason et al. | 52/100 |
| 4,319,439 | A | 3/1982 | Gussow | 52/288 |
| 4,320,613 | A | 3/1982 | Kaufman | 52/521 |
| 4,327,528 | A | 5/1982 | Fritz | 52/309.1 |
| 4,389,824 | A | 6/1983 | Anderson | 52/211 |
| 4,424,655 | A | 1/1984 | Trostle | 52/520 |
| 4,429,503 | A | 2/1984 | Holliday | 52/410 |
| 4,450,665 | A | 5/1984 | Katz | 52/522 |
| D274,947 | S | 7/1984 | Culpepper, Jr. et al. | D25/73 |
| 4,506,486 | A | 3/1985 | Culpepper, Jr. et al. | 52/529 |
| 4,593,512 | A | 6/1986 | Funaki | 52/519 |
| 4,608,800 | A | 9/1986 | Fredette | 52/656 |
| 4,649,008 | A | 3/1987 | Johnstone et al. | 264/177.1 |
| 4,680,911 | A | 7/1987 | Davis et al. | 52/521 |
| D291,249 | S | 8/1987 | Manning | D25/73 |
| 4,694,628 | A | 9/1987 | Vondergoltz et al. | 52/528 |
| 4,709,519 | A | 12/1987 | Liefer et al. | 52/98 |
| 4,716,645 | A | 1/1988 | Pittman et al. | 29/527.1 |
| 4,782,638 | A | 11/1988 | Hovind | 52/547 |
| 4,814,413 | A | 3/1989 | Thibaut et al. | 528/80 |
| 4,843,790 | A | 7/1989 | Taravella | 52/211 |
| 4,856,975 | A | 8/1989 | Gearhart | 425/131.1 |
| 4,864,788 | A | 9/1989 | Tippmann | 52/309.8 |
| 4,911,628 | A | 3/1990 | Heilmayr et al. | 425/131.1 |
| 4,920,709 | A | 5/1990 | Garries et al. | 52/85 |
| 4,930,287 | A | 6/1990 | Volk et al. | 52/748 |
| 4,962,622 | A | 10/1990 | Albrecht et al. | 52/630 |
| 4,969,302 | A | 11/1990 | Coggan et al. | 52/309.8 |
| D316,299 | S | 4/1991 | Hurlburt | D25/119 |
| 5,016,415 | A | 5/1991 | Kellis | 52/522 |
| 5,022,204 | A | 6/1991 | Anderson | 52/211 |
| 5,022,207 | A | 6/1991 | Hartnett | 52/537 |
| 5,024,045 | A | 6/1991 | Fluent et al. | 53/443 |
| 5,050,357 | A | 9/1991 | Lawson | 52/314 |
| 5,080,950 | A | 1/1992 | Burke | 428/81 |
| 5,090,174 | A | 2/1992 | Fragale | 428/309.9 |
| 5,103,612 | A | 4/1992 | Wright | 52/288 |
| 5,224,315 | A | 7/1993 | Winter, IV | 52/309.8 |
| 5,230,377 | A | 7/1993 | Berman | 160/327 |
| D342,579 | S | 12/1993 | Mason | D25/119 |
| 5,282,344 | A | 2/1994 | Moore | 52/716.8 |
| 5,303,525 | A | 4/1994 | Magee | 52/306 |
| 5,306,548 | A | 4/1994 | Zabrocki et al. | 428/215 |
| 5,318,737 | A | 6/1994 | Trabert et al. | 264/171 |
| 5,347,784 | A | 9/1994 | Crick et al. | 52/520 |
| 5,363,623 | A | 11/1994 | King | 52/520 |
| 5,415,921 | A | 5/1995 | Grohman | 428/216 |
| D361,138 | S | 8/1995 | Moore et al. | D25/119 |
| 5,443,878 | A | 8/1995 | Treloar et al. | 428/60 |
| 5,461,839 | A | 10/1995 | Beck | 52/519 |
| 5,465,486 | A | 11/1995 | King | 29/897.32 |
| 5,465,543 | A | 11/1995 | Seifert | 52/309.8 |
| 5,475,963 | A | 12/1995 | Chelednik | 52/545 |
| 5,482,667 | A | 1/1996 | Dunton et al. | 264/316 |
| 5,502,940 | A | 4/1996 | Fifield | 52/309.12 |
| 5,537,791 | A | 7/1996 | Champagne | 52/520 |
| 5,548,940 | A | 8/1996 | Baldock | 53/430 |
| 5,551,204 | A | 9/1996 | Mayrand | 52/795.1 |
| 5,560,170 | A | 10/1996 | Ganser et al. | 52/539 |
| 5,564,246 | A | 10/1996 | Champagne | 52/548 |
| 5,565,056 | A | 10/1996 | Lause et al. | 156/243 |
| 5,575,127 | A | 11/1996 | O'Neal | 52/520 |
| 5,581,970 | A | 12/1996 | O'Shea | 52/718.01 |
| 5,586,415 | A | 12/1996 | Fisher et al. | 52/58 |
| 5,598,677 | A | 2/1997 | Rehm, III | 52/407.1 |
| 5,613,337 | A | 3/1997 | Plath et al. | 52/533 |
| 5,622,020 | A | 4/1997 | Wood | 52/546 |
| 5,634,314 | A | 6/1997 | Champagne | 52/712 |
| 5,651,227 | A * | 7/1997 | Anderson | 52/520 |
| 5,661,939 | A | 9/1997 | Coulis et al. | 52/519 |
| 5,662,977 | A | 9/1997 | Spain et al. | 428/42.1 |
| 5,675,955 | A | 10/1997 | Champagne | 52/521 |
| 5,678,367 | A | 10/1997 | Kline | 52/211 |
| 5,694,728 | A | 12/1997 | Heath, Jr. et al. | 52/554 |
| 5,720,114 | A | 2/1998 | Guerin | 33/451 |
| 5,729,946 | A | 3/1998 | Beck | 52/520 |
| 5,737,881 | A | 4/1998 | Stocksieker | 52/90.1 |
| 5,765,333 | A | 6/1998 | Cunningham | 52/481.1 |
| 5,768,844 | A | 6/1998 | Grace, Sr. et al. | 52/529 |
| 5,791,093 | A | 8/1998 | Diamond | 52/36.5 |
| 5,806,185 | A | 9/1998 | King | 29/897.32 |
| 5,809,731 | A | 9/1998 | Reiss | 52/533 |
| 5,829,206 | A | 11/1998 | Bachman | 52/94 |
| 5,836,113 | A | 11/1998 | Bachman | 52/94 |
| D402,770 | S | 12/1998 | Hendrickson et al. | D25/141 |
| 5,857,303 | A | 1/1999 | Beck et al. | 52/520 |
| 5,866,639 | A | 2/1999 | Dorchester et al. | 523/171 |
| 5,878,543 | A * | 3/1999 | Mowery | 52/519 |
| 5,946,876 | A | 9/1999 | Grace, Sr. et al. | 52/520 |
| 5,956,914 | A | 9/1999 | Williamson | 52/520 |
| 5,974,756 | A | 11/1999 | Alvarez et al. | 52/553 |
| 6,029,415 | A | 2/2000 | Culpepper et al. | 52/522 |
| 6,035,587 | A | 3/2000 | Dressler | 52/97 |
| 6,047,507 | A | 4/2000 | Lappin et al. | 52/212 |
| 6,050,041 | A | 4/2000 | Mowery et al. | 52/520 |
| 6,086,997 | A | 7/2000 | Patel et al. | 428/355 BL |
| D429,009 | S | 8/2000 | Ginzel | D25/136 |
| 6,122,877 | A | 9/2000 | Hendrickson et al. | 52/520 |
| 6,161,354 | A | 12/2000 | Gilbert et al. | 52/520 |
| 6,187,424 | B1 | 2/2001 | Kjellqvist et al. | 428/220 |
| 6,195,952 | B1 | 3/2001 | Culpepper et al. | 52/522 |
| 6,223,488 | B1 | 5/2001 | Pelfrey et al. | 52/302.1 |
| 6,260,251 | B1 | 7/2001 | Guhl | 29/416 |
| 6,263,574 | B1 | 7/2001 | Lubker, II et al. | 29/897.32 |
| 6,272,797 | B1 | 8/2001 | Finger | 52/94 |
| D447,820 | S | 9/2001 | Grace | D25/119 |
| 6,282,858 | B1 | 9/2001 | Swick | 52/533 |
| D448,865 | S | 10/2001 | Manning | D25/141 |
| 6,295,777 | B1 | 10/2001 | Hunter et al. | 52/519 |
| D450,138 | S | 11/2001 | Barber | D25/141 |
| 6,321,500 | B1 | 11/2001 | Manning et al. | 52/555 |
| 6,336,988 | B1 | 1/2002 | Enlow et al. | 156/238 |
| 6,348,512 | B1 | 2/2002 | Adriani | 521/85 |
| D454,962 | S | 3/2002 | Grace | D25/119 |
| 6,358,585 | B1 | 3/2002 | Wolff | 428/36.6 |
| 6,360,498 | B1 | 3/2002 | Westphal | 52/204.5 |
| 6,360,508 | B1 | 3/2002 | Pelfrey et al. | 52/520 |
| 6,363,676 | B1 | 4/2002 | Martion, III | 52/519 |
| 6,367,220 | B1 | 4/2002 | Krause et al. | 52/512 |
| 6,442,912 | B1 | 9/2002 | Phillips et al. | 52/741.4 |
| 6,516,577 | B2 | 2/2003 | Pelfrey et al. | 52/302.1 |
| D471,292 | S | 3/2003 | Barber | D25/141 |
| 6,526,718 | B2 | 3/2003 | Manning et al. | 52/555 |
| 6,539,675 | B1 | 4/2003 | Gile | 52/96 |
| 6,594,965 | B2 | 7/2003 | Coulton | 52/302.1 |
| 6,625,939 | B1 | 9/2003 | Beck et al. | 52/105 |
| D481,804 | S | 11/2003 | Pelfrey | D25/119 |
| 6,673,868 | B2 | 1/2004 | Choulet | 525/70 |
| 6,784,230 | B1 | 8/2004 | Patterson et al. | 524/13 |
| 6,865,849 | B1 | 3/2005 | Mollinger et al. | 52/96 |
| 6,886,301 | B2 | 5/2005 | Schilger | 52/302.1 |
| 2001/0041256 | A1 | 11/2001 | Heilmayr | 428/318.6 |
| 2002/0018907 | A1 | 2/2002 | Zehner | 428/537.1 |
| 2002/0020125 | A1 | 2/2002 | Pelfrey et al. | 52/302.1 |
| 2002/0025420 | A1 | 2/2002 | Wanat et al. | 428/213 |

| | | | | |
|---|---|---|---|---|
| 2002/0029537 | A1 | 3/2002 | Manning et al. | 52/518 |
| 2002/0054996 | A1 | 5/2002 | Rheenen | 428/420 |
| 2002/0056244 | A1 | 5/2002 | Hertweck | 52/520 |
| 2002/0076544 | A1 | 6/2002 | DeWorth et al. | 428/317.1 |
| 2002/0078650 | A1 | 6/2002 | Bullinger et al. | 52/539 |
| 2002/0090471 | A1 | 7/2002 | Burger et al. | 428/15 |
| 2002/0108327 | A1 | 8/2002 | Shaw | 52/211 |
| 2002/0177658 | A1 | 11/2002 | Tajima et al. | 525/85 |
| 2003/0014936 | A1 | 1/2003 | Watanabe | 52/518 |
| 2003/0056458 | A1 | 3/2003 | Black et al. | 52/541 |
| 2003/0131551 | A1 | 7/2003 | Mollinger et al. | 52/518 |
| 2003/0154664 | A1 | 8/2003 | Beck et al. | 52/105 |
| 2004/0003566 | A1 | 1/2004 | Sicuranza | 52/518 |
| 2004/0026021 | A1 | 2/2004 | Groh et al. | 156/244.12 |
| 2004/0142157 | A1 | 7/2004 | Melkonian | 428/292.1 |
| 2004/0211141 | A1 | 10/2004 | Sandy | 52/506.01 |

FOREIGN PATENT DOCUMENTS

| | | | |
|---|---|---|---|
| CA | 2267000 | | 4/2003 |
| CL | 3.856 | | 5/2001 |
| DE | 4 01 04 760.1 | | 5/2001 |
| EP | 1086 988 | A1 | 3/2001 |
| GB | 2101944 | | 8/2001 |
| JP | 364001539 | A | 1/1989 |
| JP | 09141752 | A | 6/1997 |
| JP | 410018555 | A | 12/1998 |
| JP | 02001079951 | A | 3/2001 |
| KR | 321694 | | 3/2003 |
| PL | 4115 | | 7/2004 |
| WO | WO 00/55446 | | 9/2000 |

OTHER PUBLICATIONS

Web site print outs from www.dupontdow.com, "Adhesives," Aug. 12, 2000, 3 pages.

Web site print outs from www.dupontdow.com, "Neoprene—Grades of Neoprene—AquaStik™ Water Based Polychloroprene." Aug. 12, 2000, 2 pages.

Web site print outs from www.dupontdow.com, "Neoprene—Grades of Neoprene—Neoprene Solid Grades for Solvent-Based Adhesives." Aug. 12, 2000, 2 pages.

"New Craneboard sold core siding redefines home exterior siding," Crane Performance Siding news release online, Mar. 20, 2001, 3 pages.

Jim Weiker, "Crance puts new face on siding," The Columbus Dispatch, May 9, 2002, 3 pages.

Innovations for Living, "What Do I Look For in Quality Vinyl Siding?" Owens Corning, Nov. 9, 2002, 1 page.

Crane in the News, International Builders' Show Preview, Jan./Feb. 2003, 1 page.

Mark Feirer, "Vinyl Siding, Love it or hate it, plastic is here to stay," This Old House Online, no date, 8 pages.

* cited by examiner

LINEAL

This is a continuation of U.S. application Ser. No. 10/357,120, filed Feb. 3, 2003, which is hereby incorporated by reference in its entirety.

BACKGROUND AND SUMMARY OF THE INVENTION

The present invention relates generally to building materials and, more specifically, to materials for framing openings in a building.

To provide a professional, finished appearance, openings in a building are often framed by lineals. Lineals may be wide-faced pieces that trim or frame a door or window or other types of openings. In the present invention, the lineal may include a nail hem portion having a plurality of openings and an overhang. The nail hem portion may be fastened to the building surface. The lineal may include a channel portion that snaps or slides onto the lineal. The channel portion and the lineal of the present invention may be manufactured as a one-piece unit or as a two-piece unit. The lineal of the present invention may have a backing of insulation.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

Figure 1:
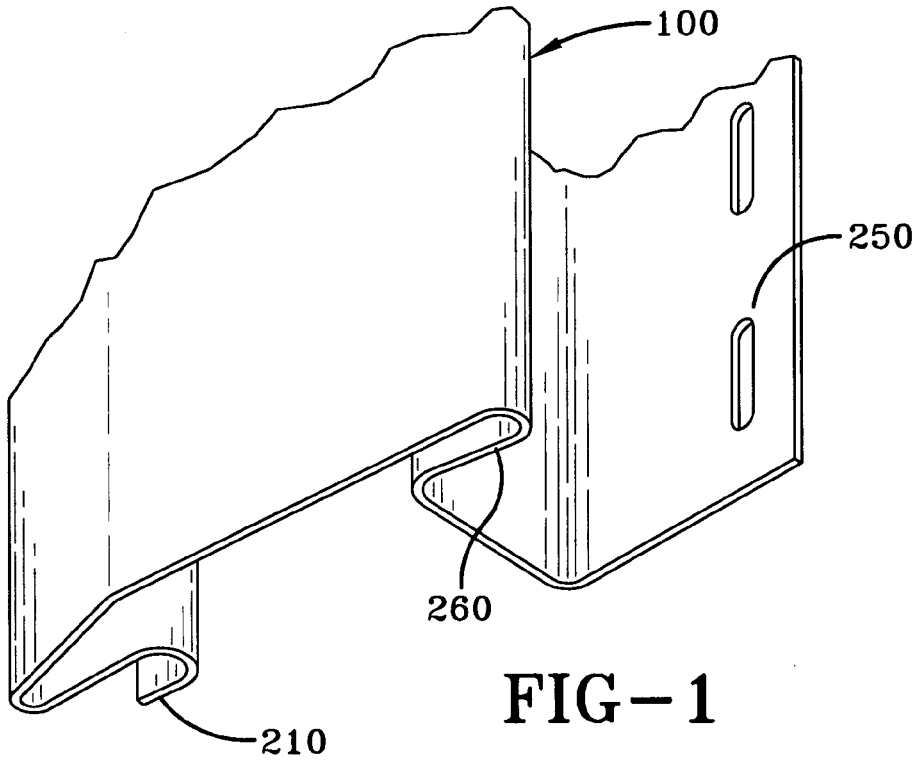
FIG. 1 is a perspective view of an exemplary lineal according to the present invention.

FIG. 1 is a perspective view of an exemplary lineal 100 according to the present invention. The lineal may include a nailing hem 250 and an overhang 260. The lineal 100 may also comprise a generally J-shaped channel 210 for accepting or being received in another channel portion. In other embodiments, the channel portion 210 may have any other suitable shape for being engaged with another channel portion.

Some window frame assemblies may include an integral channel portion (e.g., a J-channel portion) that is adapted to engage the J-shaped channel 210. In other embodiments, the channel portion that accepts or is received in the J-shaped channel 210 may be a separate component from the window frame assembly. For example, the channel portion that accepts or is received in the J-shaped channel 210 may be an integral or separable portion of the lineal.

Figure 2:
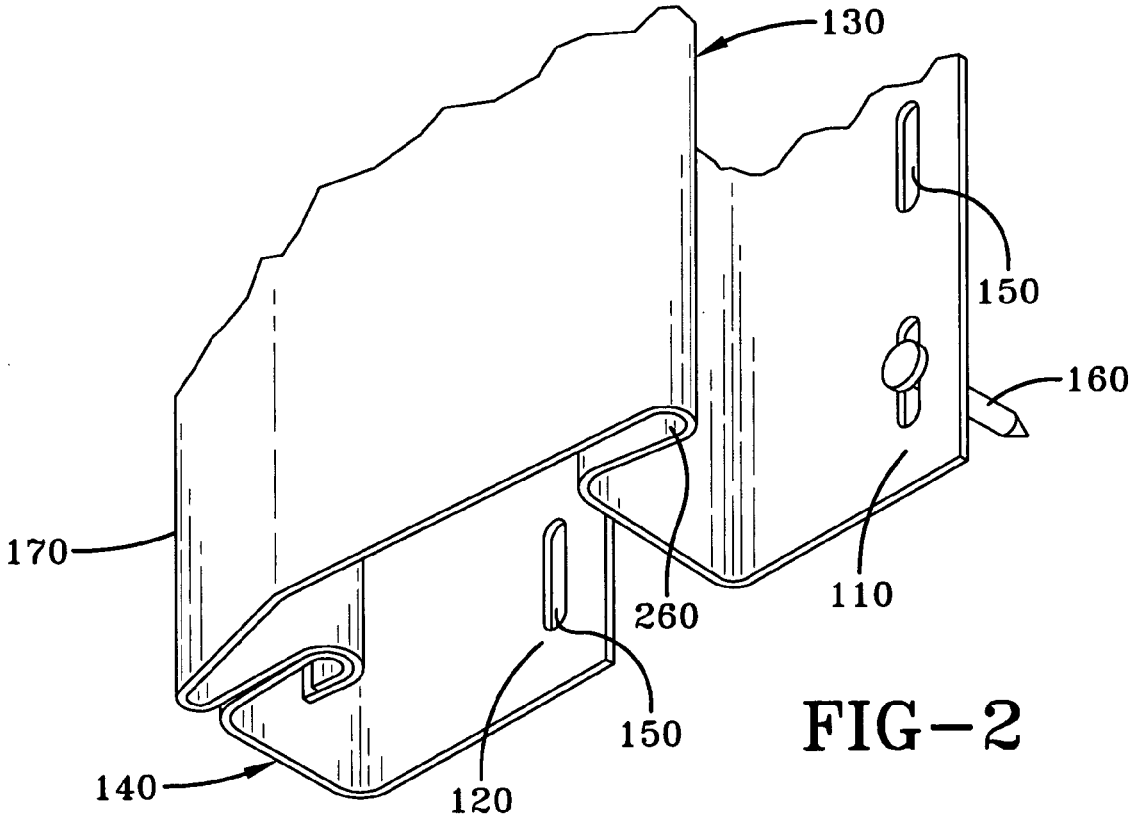
FIG. 2 is a perspective view of another exemplary lineal according to the present invention.

FIG. 2 is a perspective view of another exemplary lineal 130 according to the present invention. This embodiment of the lineal 130 may include a portion that is substantially similar to the lineal 100 of FIG. 1. The edge 170 of the lineal 130 may be positioned generally adjacent to the opening to be framed. The lineal 130 may include two nailing hems 110 and 120. The lineal 130 may include a channel portion 140 to which the nailing hem 120 is attached. The nailing hems may have a plurality of openings 150 for receiving fasteners 160.

Figure 9:
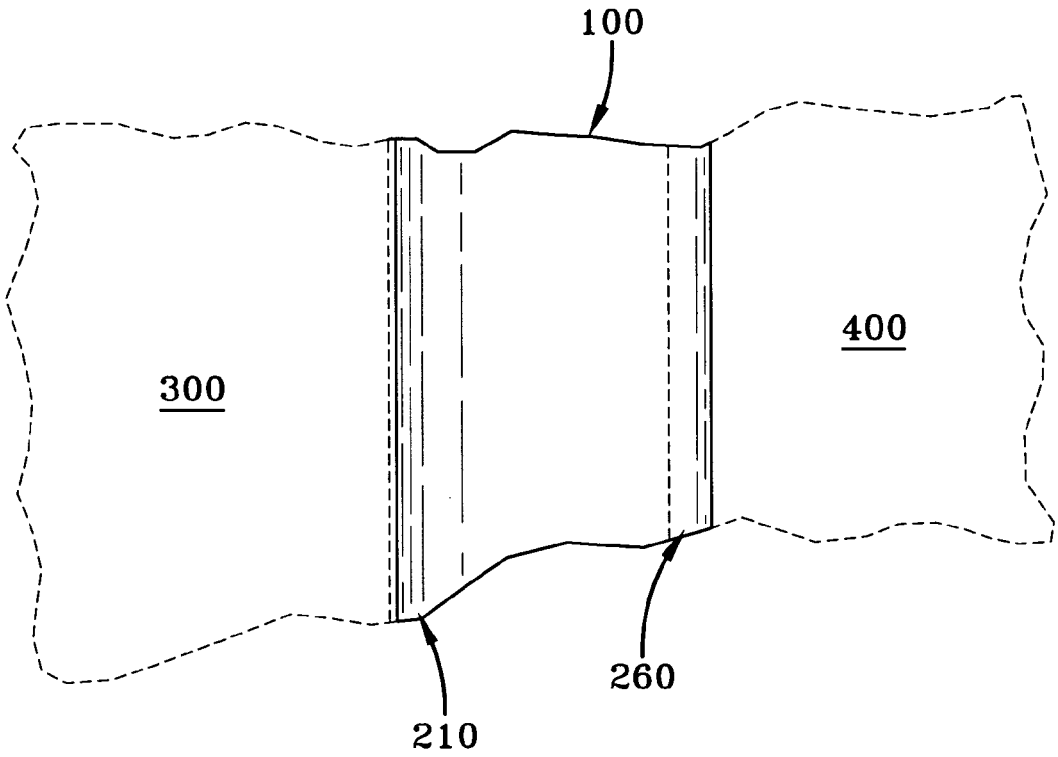
FIG. 9 is a top plan view of an assembly including the lineal of FIG. 1 (an opening in a structure and a reinforced siding panel are shown in phantom).

As used, the lineal of the present invention may frame an opening or any other desired portion of a building. For example, a lineal of the present invention may be used to surround a window or a door. The building may have siding that abuts the lineal and lies on top of the nailing hem 110 and under the overhang 260 of the lineal. FIG. 9 shows an example of the lineal 100 framing an opening 300 (e.g., a window or a door) in a structure. In addition, FIG. 9 shows an example of a reinforced siding panel 400 inserted in the gap between the overhang and the nailing hem of lineal 100.

Figure 3:
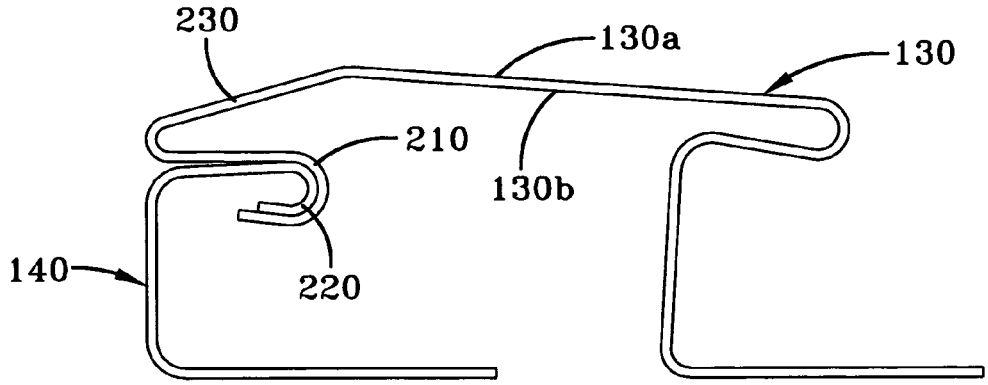
FIG. 3 is a side elevational view of the lineal of FIG. 2.

Referring to FIG. 3, the configuration of the exemplary lineal 130 is shown. The channel portion 140 is shown assembled as a portion of the lineal 130. The top or face portion 130*a* of the lineal 130 may be smooth or may have any number of finishes that are typically known by those in the art of manufacturing vinyl siding. The face portion 130*a* may include an angled portion 230. The angled portion 230 may function to channel water from the face of the lineal. The underside 130*b* of the lineal 130 may optionally be coated and/or filled with insulation (e.g., foam insulation). The channel portion 140 may be a permanently affixed portion of the lineal 130, or the channel portion 140 may be a releasably engaged portion of the lineal 130.

Figure 4:
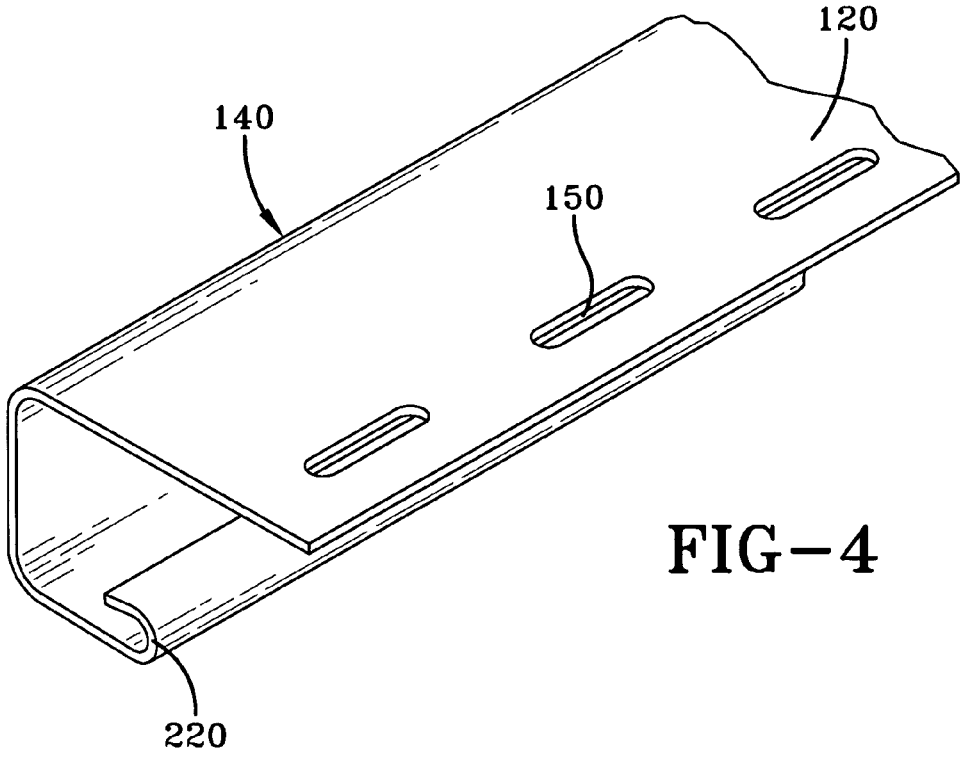
FIG. 4 is a perspective view of an exemplary channel portion of a lineal according to the present invention.

FIG. 4 shows a perspective view of the channel portion 140 of a lineal assembly. The nailing hem 120 may hold the channel portion 140 in place against a wall by use of one or more fasteners in the plurality of openings 150 in the nailing hem 120. In an alternative embodiment, the nailing hem 120 may extend away from the lineal 130.

Figure 5A:
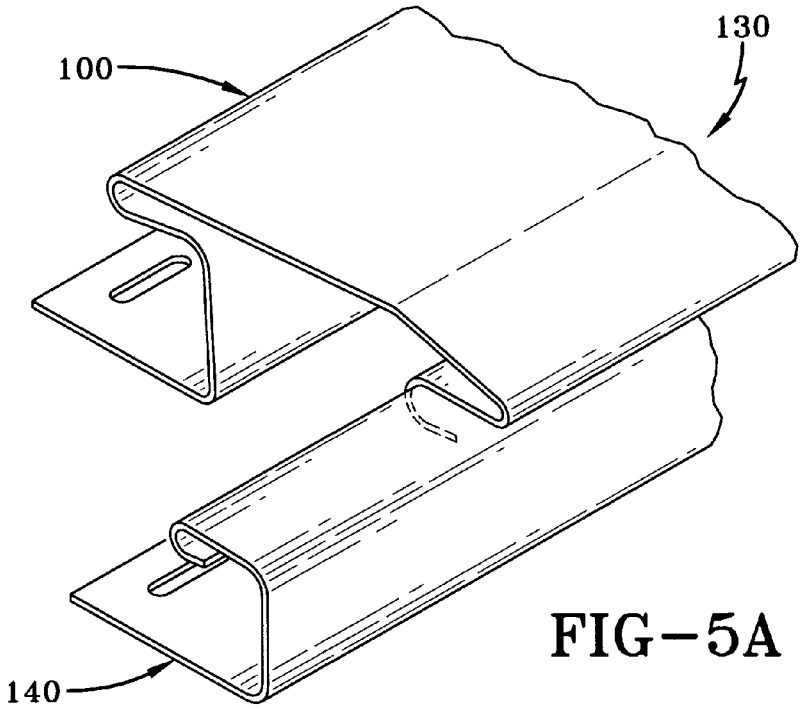
FIG. 5A is a perspective view of an exemplary, partially assembled two-piece lineal according to the present invention.
Figure 5B:
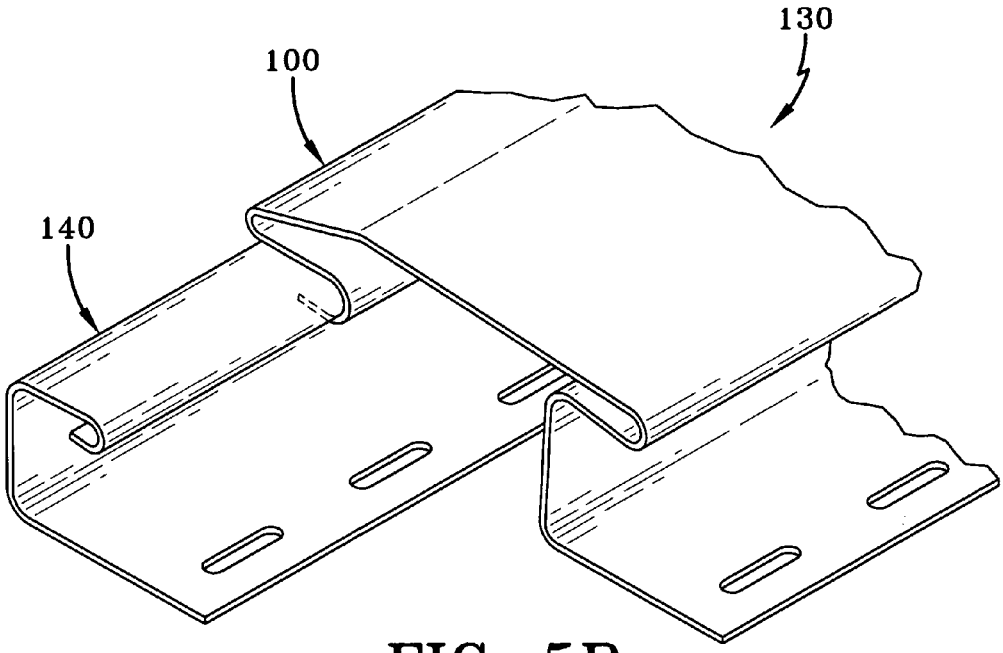
FIG. 5B is another perspective view of the lineal of FIG. 5A.
Figure 6:
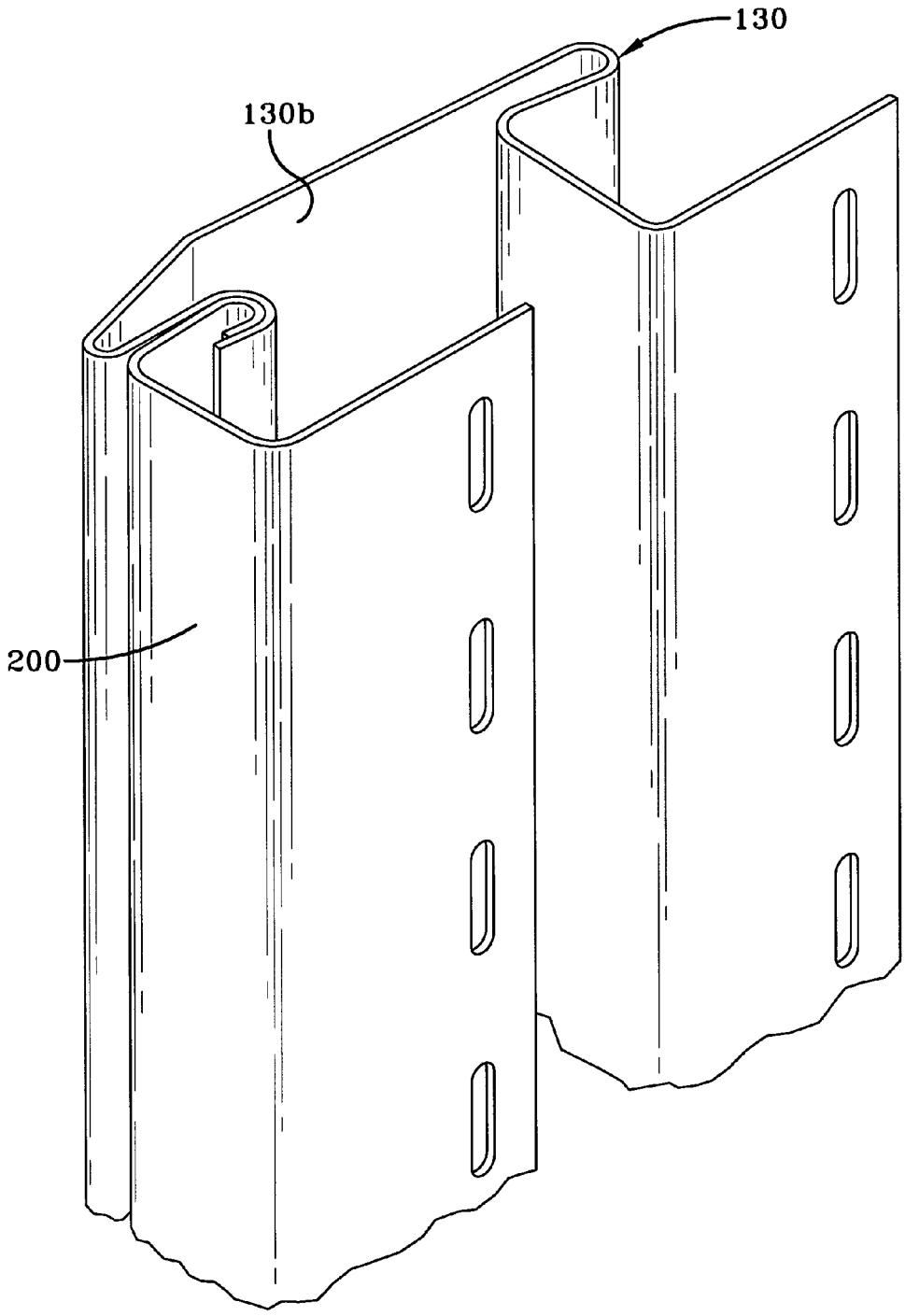
FIG. 6 is another perspective view of the exemplary lineal of FIG. 2.
Figure 7:
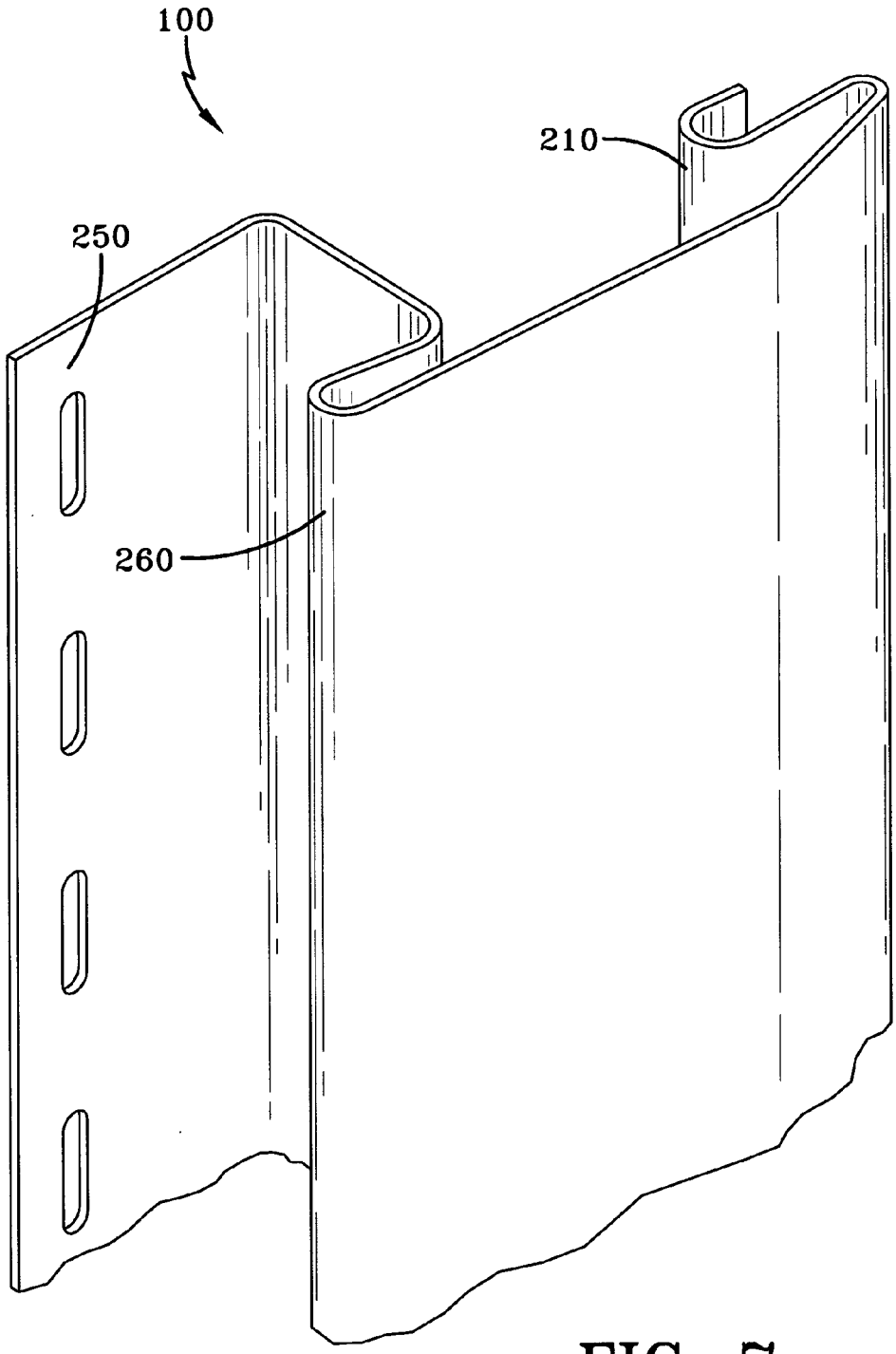
FIG. 7 is another perspective view of the lineal of FIG. 1.
Figure 8:
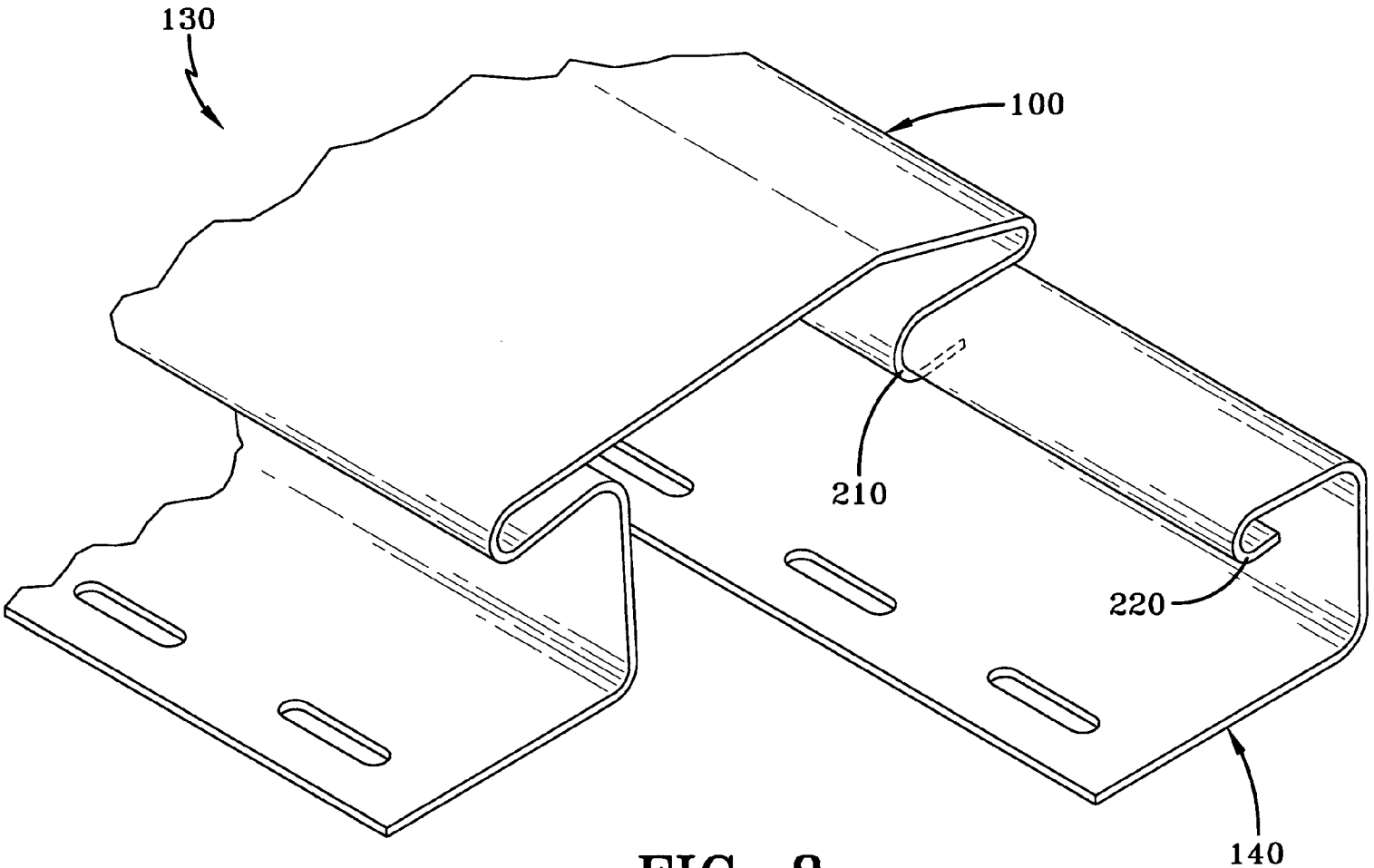
FIG. 8 is a yet another perspective view of the lineal of FIG. 5A.
Figure 10:
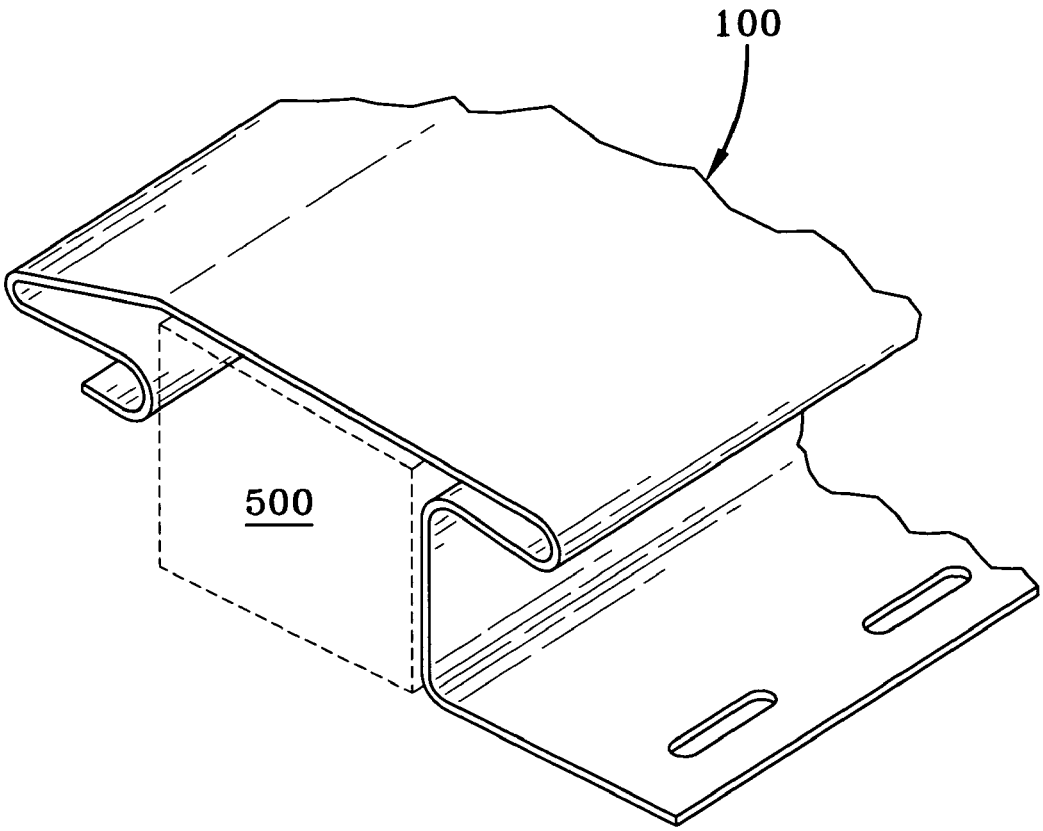
FIG. 10 is a perspective view of the lineal of FIG. 1 (an optional piece of insulation is shown in phantom).

The generally J-shaped channel 210 may slide or snap onto the channel portion 140 as shown in FIG. 5A and FIG. 5B. Alternatively, the channel portion 140 may slide or snap onto the generally J-shaped channel 210. These two portions may also be manufactured as a one-unit piece in an alternative embodiment. The top 130*a* of the lineal 130 may substantially cover the channel portion 140 such that there may be an edge 200 that extends around the opening being framed as is shown in the perspective view of FIG. 6. The interior of the lineal 130 may optionally be coated and/or filled with insulation. For example, FIG. 10 shows an example of insulation 500 adjacent to the underside of lineal 100.

The lineal of the present invention may be of various widths and thicknesses. The exemplary embodiment of the lineal 100 of FIG. 1 may be approximately 3.5 inches wide. Other exemplary embodiments may be in the range of approximately 2 inches to approximately 10 inches in width according to manufacturer's preferences. It should also be recognized that other exemplary embodiments of the present invention may be less than 2 inches wide or greater than 10 inches wide. The generally J-shaped channel 210 of the lineal 100 may slide onto or snap into a generally J-shaped channel 220 of the channel portion 140 (or vice versa). Similar to the channel portion 210, the channel portion 220 may have any other suitable shape. In another embodiment of the present invention, the channel portion 140 of the lineal 130 may be an integral portion of a one-piece unit. In one embodiment of a one-piece unit, the channel portions 210 and 220 may be eliminated.

The lineal of the present invention may be a transitional lineal. For example, a channel portion 140 has a gap of a certain distance between the J-channel portion 220 and the nailing hem 120. Likewise, a channel portion that is an integral part of a window frame assembly may also have a similar type of gap. These gaps may be of a suitable distance for accepting a piece of siding that has a certain thickness. These gaps, for example, may be between about 0.5 inch and about 1 inch (e.g., about 0.75 inch) in some embodiments. The gaps of these channel portions may not be suitable for accepting siding that has a significantly greater thickness. For instance, siding that has a foam backing or another type of reinforcement panel may be too thick to fit into the gap of the channel portion. However, a lineal of the present invention may provide a larger gap that is suitable for accepting the thicker siding. Referring to the exemplary embodiment of FIG. 1, the lineal 100 has a gap between the overhang 260 and the nailing hem 250. This gap may be of a distance that is greater than the distance of the gap of the channel portion. For example, this gap may be greater than about 1.0 inch (e.g., about 1.125 inch) in some embodiments. FIG. 3 shows an exemplary embodiment in which the gap underneath the overhang is greater than the gap created by the channel portion 140. As a result, a thicker piece of siding may be received in the gap underneath the overhang, such as a piece of siding that has foam backing. The angled portion 230 functions as a transition between the smaller gap of the channel portion 140 and the larger gap underneath the overhang. In other words, the angled portion compensates for the different distances of the aforementioned gaps. In this particular example, the angled portion extends only across a portion of the top 130*a*. However, it should be recognized that an angled portion of other exemplary embodiments may extend across the entire face of the lineal.

The lineal as described herein may be formed from a polymer such as a vinyl material. Other materials such as polypropylene, polyethylene, other plastics and polymers, polymer composites (such as polymer reinforced with fibers or other particles of glass, graphite, wood, flax, or other inorganic or organic materials), metals (such as aluminum or polymer coated metal), or other similar or suitable materials may also be used. The lineal may be molded, extruded, roll-formed from a flat sheet, or formed by any other suitable manufacturing technique.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A one-piece trim lineal component comprising:

a) a nailing hem extending substantially horizontally in a first direction and in a first plane;

b) an overhang portion extending from and over said nailing hem thereby forming a first gap of a first gap dimension;

c) a face portion extending from said overhang portion in a direction opposite said first direction; and d) a channel portion having a lower-most surface, said channel portion extending substantially horizontally from and below said face portion in a second plane higher than said first plane, thereby forming a second gap of a second gap dimension between said lower-most surface of said channel portion and said first plane;

wherein said first gap dimension is greater than said second gap dimension.

2. The trim lineal component of claim 1 wherein said trim lineal component longitudinally extends adjacent to an opening in a structure.

3. The trim lineal component of claim 2 wherein said trim lineal component longitudinally extends adjacent to a window.

4. The trim lineal component of claim 2 wherein said trim lineal component longitudinally extends adjacent to a door.

5. The trim lineal component of claim 1 wherein said face portion extends outwardly at an angle from said channel portion and then levels to connect to said overhang portion.

6. The trim lineal component of claim 1 wherein said face portion is about 3.5 inches wide.

7. The trim lineal component of claim 1 wherein said second gap dimension is between about 0.5 inch and about 1 inch.

8. The trim lineal component of claim 1 wherein said second gap dimension is about 0.75 inch.

9. The trim lineal component of claim 1 wherein said first gap dimension is greater than about 1.0 inch.

10. The trim lineal component of claim 1 wherein said first gap dimension is about 1.125 inches.

11. The trim lineal component of claim 1 wherein:

said second gap dimension is about 0.75 inch; and said first gap dimension is about 1.125 inches.

12. The trim lineal component of claim 1 further comprising insulation adjacent an underside of said trim lineal component.

13. The trim lineal component of claim 12 wherein said insulation is a piece of foam.

14. An assembly comprising the trim lineal component of claim 1, the assembly further comprising a reinforced siding panel inserted in said first gap.

15. The assembly of claim 14 wherein said reinforced siding panel is a foam-backed siding panel.

16. A trim lineal component comprising:

a) a nailing hem extending substantially horizontally in a first direction and in a first plane;

b) an overhang portion extending from and over said nailing hem thereby forming a first gap of a first gap dimension;

c) a face portion extending from said overhang portion in a direction opposite said first direction; and d) a channel portion having a lower-most surface, said channel portion extending substantially horizontally from and below said face portion in a second plane higher than said first plane, thereby forming a second gap of a second gap dimension between said lower-most surface of said channel portion and said first plane;

wherein said first gap dimension is greater than said second gap dimension;

wherein said channel portion is adapted to receive a J-channel portion of another component; and wherein said face portion is adapted to substantially cover said J-channel portion of said other component.

17. An assembly comprising the trim lineal component of claim 16, the assembly further comprising:

a piece of foam adjacent an underside of said trim lineal component; and a reinforced siding panel inserted in said first gap.

18. An assembly comprising:

a trim lineal component comprising:

a) a nailing hem extending substantially horizontally in a first direction and in a first plane;

b) an overhang portion extending from and over said nailing hem thereby forming a first gap of about 1.125 inches between said overhang portion and said nailing hem;

c) a face portion extending from said overhang portion in a direction opposite said first direction; and d) a channel portion having a lower-most surface, said channel portion extending substantially horizontally from and below said face portion in a second plane higher than said first plane, thereby forming a second gap of a second gap dimension between said lower-most surface of said channel portion and said first plane;

a piece of foam adjacent an underside of said trim lineal component; and a reinforced siding panel inserted in said first gap.

19. The trim lineal component of claim 1 wherein said channel portion is adapted to receive a J-channel portion of another component.

20. The assembly of claim 18 wherein said channel portion of said trim lineal component is adapted to receive a J-channel portion of another component.

* * * * *

UNITED STATES PATENT AND TRADEMARK OFFICE

CERTIFICATE OF CORRECTION

PATENT NO. : 6,988,345 B1
DATED : January 24, 2006
INVENTOR(S) : Pelfrey et al.

It is certified that error appears in the above-identified patent and that said Letters Patent is hereby corrected as shown below:

Title page,
Item [56], References Cited, FOREIGN PATENT DOCUMENTS, insert -- GB 1,068,202 5/1967 --, and
OTHER PUBLICATIONS, delete "Jim Weiker, "Crance puts new face on siding," The Columbus Dispatch, May 9, 2002, 3 pages." and insert -- Jim Weiker, "Crane puts new face on siding," The Columbus Dispatch, May 9, 2002, 3 pages. --.

Signed and Sealed this

Twenty-first Day of March, 2006

JON W. DUDAS
*Director of the United States Patent and Trademark Office*